US006126406A

United States Patent [19]

Kawaguchi et al.

[11] Patent Number: 6,126,406

[45] Date of Patent: Oct. 3, 2000

[54] VARIABLE DISPLACEMENT COMPRESSOR

[75] Inventors: Masahiro Kawaguchi; Takuya Okuno; Tetsuhiko Fukanuma; Hiroyuki Nagai, all of Kariya, Japan

[73] Assignee: Kabushiki Kaisha Toyoda Jidoshokki Seisakusho, Kariya, Japan

[21] Appl. No.: 08/972,651

[22] Filed: Nov. 18, 1997

[30] Foreign Application Priority Data

Nov. 20, 1996 [JP] Japan ..... 8-309249

[51] Int. Cl.[7] ..... F04B 1/26

[52] U.S. Cl. ..... 417/222.2

[58] Field of Search ..... 417/222.1, 222.2

[56] References Cited

U.S. PATENT DOCUMENTS

| | | | |
|---|---|---|---|
| 4,632,405 | 12/1986 | Kawane | 277/150 |
| 5,584,670 | 12/1996 | Kawaguchi et al. | 417/222.2 |
| 5,636,973 | 6/1997 | Sonobe et al. | 417/222.2 |
| 5,741,122 | 4/1998 | Yokono et al. | 417/222.2 |

FOREIGN PATENT DOCUMENTS

| | | |
|---|---|---|
| 0 207 613 A1 | 1/1987 | European Pat. Off. . |
| 19517334A1 | 11/1995 | Germany . |
| 19612395A1 | 10/1996 | Germany . |
| 735040 | 2/1995 | Japan . |
| 8159022 | 6/1996 | Japan . |
| 08193586A | 7/1996 | Japan . |
| 08210283A | 8/1996 | Japan . |

*Primary Examiner*—Timothy S. Thorpe
*Assistant Examiner*—Michael K. Gray
*Attorney, Agent, or Firm*—Morgan & Finnegan, L.L.P.

[57] ABSTRACT

A housing of a compressor has a shutter chamber for accommodating a shutter. The shutter moves between a closed position, where the shutter stops flow of gas from an external circuit into a suction chamber, and an open position, where the shutter permits the gas flow in response to the tilting motion of a swash plate. A coil spring, which has a conical shape, is located in the shutter chamber to bias the shutter in a direction toward the open position from the closed position. The spring is arranged to prevent the spring from sliding against the inner wall of the shutter chamber when the spring is expanded or contracted by movement of the shutter member.

13 Claims, 5 Drawing Sheets

VARIABLE DISPLACEMENT COMPRESSOR

BACKGROUND OF THE INVENTION

The present invention relates to variable displacement compressors that control the inclination of a swash plate based on the difference between the pressure in a crank chamber and the pressure in cylinder bores. More particularly, the present invention pertains to a clutchless type variable displacement compressor.

Typically, vehicles have a variable displacement compressor used in an air conditioner. This and other auxiliary devices are actuated by the drive force of the vehicle engine through a drive train including a pulley and a V-belt. Some auxiliary devices, such as the variable displacement compressor, are not actuated all the time. It is therefore common to provide an electromagnetic clutch between the auxiliary device and the engine for selectively transmitting the drive force of the engine to the auxiliary device. For example, if provided between an engine and a compressor, the electromagnetic clutch selectively connects and disconnects the drive shaft of the compressor and the engine. However, if a compressor is directly coupled to a vehicle engine without an electromagnetic clutch, the shock caused by actuation and de-actuation of the clutch is reduced. This prevents passengers from feeling the shock and noise that are produced when the clutch connects or disconnects the compressor and the engine. Further, the clutchless construction reduces the weight and the manufacturing cost of the compressor. Thus, a clutchless type variable displacement compressor has been proposed.

Japanese Unexamined Patent Publication No. 8-159022 discloses such a clutchless type variable displacement compressor. The compressor includes a swash plate and a rotary shaft that tiltably supports the swash plate. The rotary shaft is directly coupled to a pulley without an electromagnetic clutch in between. A shutter chamber is defined at the center portion of a cylinder block extending along the axis of the rotary shaft. A suction passage is defined at the center portion of a rear housing, which is secured to the rear end of the cylinder block. The suction passage is aligned with the axis of the rotary shaft. A shutter, which has a large diameter portion and a small diameter portion, is slidably accommodated in the shutter chamber. The shutter selectively opens and closes the suction passage in accordance with the inclination of the swash plate. A coil spring is also accommodated in the shutter chamber. The coil spring urges the shutter in a direction opening the suction passage (that is, toward the swash plate).

The coil spring is located between the small diameter portion of the shutter and the inner wall of the shutter chamber, and extends between a step, which is defined by the large diameter portion and the small diameter portion, and a wall of the shutter chamber. When contracting or expanding in accordance with movement of the shutter, the coil spring slides along the inner wall of the shutter chamber and the small diameter portion of the shutter. The sliding of the coil spring prevents the shutter from moving smoothly thereby hindering accurate control of the displacement of the compressor. Further, sliding of the coil spring wears the coil spring and the parts contacting the coil spring. Therefore, there is a need to prevent the coil spring from sliding on other parts to improve compressor reliability.

SUMMARY OF THE INVENTION

Accordingly, it is an objective of the present invention to provide a variable displacement compressor that has a reciprocally movable shutter and a shutter-biasing spring mounted thereon to expand and contract responsive to the shutter movement, the spring avoiding rubbing contact with the surrounding inner peripheral wall of the shutter chamber.

To achieve the above objective, the compressor according to the present invention includes a housing having a cylinder bore and a crank chamber, a drive plate located in the crank chamber and mounted on a rotary shaft, and a piston operably coupled to the drive plate and located in the cylinder bore. The drive plate converts rotation of the rotary shaft to reciprocating movement of the piston. The piston compresses gas supplied to the cylinder bore from a separate external circuit by way of a suction chamber and discharges the compressed gas from the cylinder bore to the external circuit by way of a discharge chamber. The drive plate is tiltable with respect to the rotary shaft according to a difference between the pressure in the crank chamber and the pressure in the cylinder bore. The piston moves by a stroke based on the inclination of the drive plate to control the displacement of the compressor. The compressor further includes a shutter chamber having a wall and a shutter member slidably accommodated in the shutter chamber. The shutter member is movable between a first position and a second position in response to the tilting motion of the drive plate. The shutter member connects the external circuit with the suction chamber in the first position and disconnects the external circuit from the suction chamber in the second position. A spring is located in the shutter chamber to bias the shutter member in a direction toward the first position from the second position. The spring has a longitudinal axis. The spring is spaced apart from the wall of the shutter chamber along most of the spring's axial length to prevent the spring from sliding against the wall of the shutter chamber when the spring is expanded or contracted by movement of the shutter member.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

A variable displacement compressor according to a first embodiment of the present invention will now be described with reference to FIGS. 1 to 4. The compressor is incorporated in an on-vehicle air conditioner.

Figure 1:
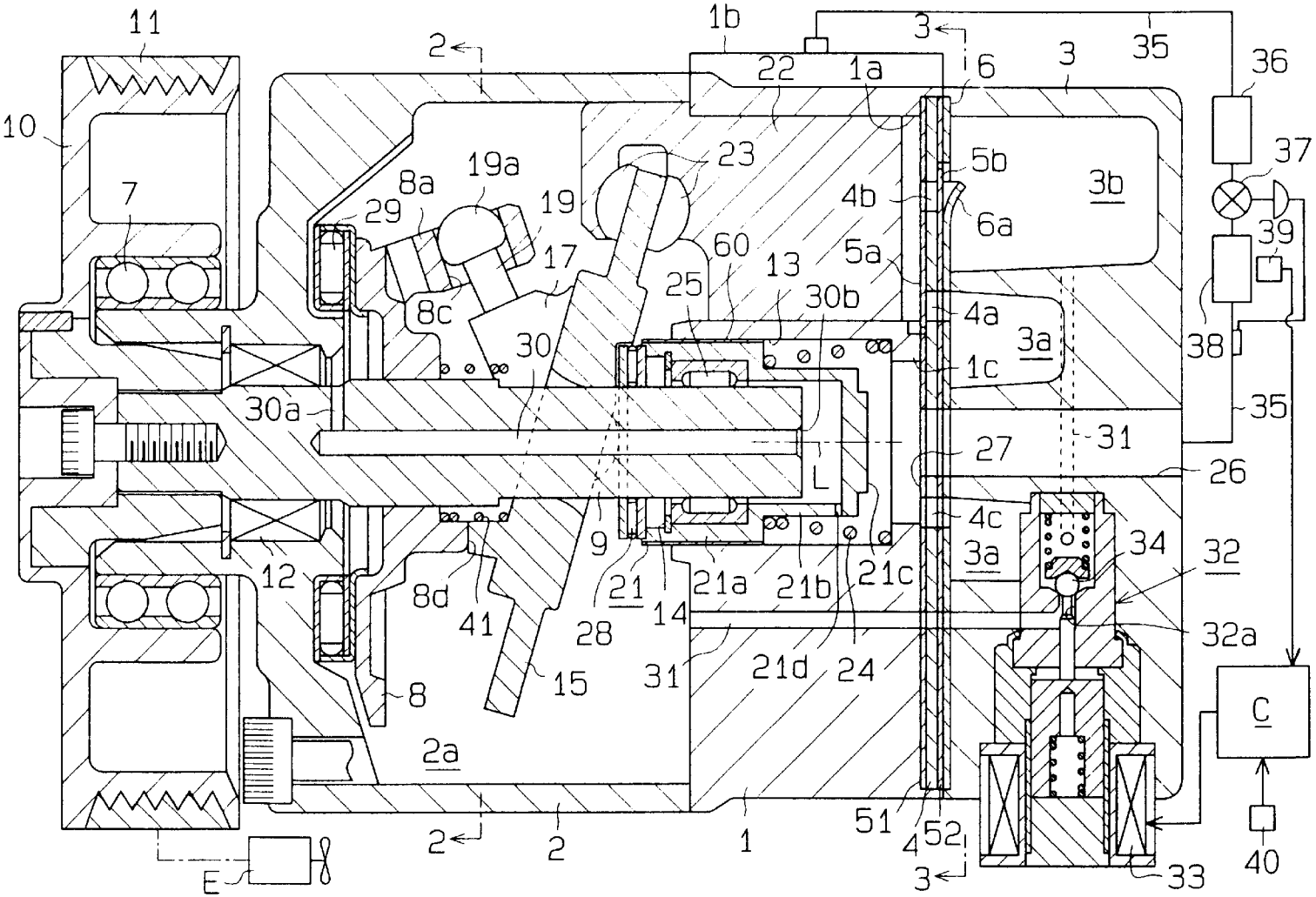
FIG. 1 is a cross-sectional view of a compressor according to a first embodiment of the present invention when a shutter is located at an open position.
Figure 4:
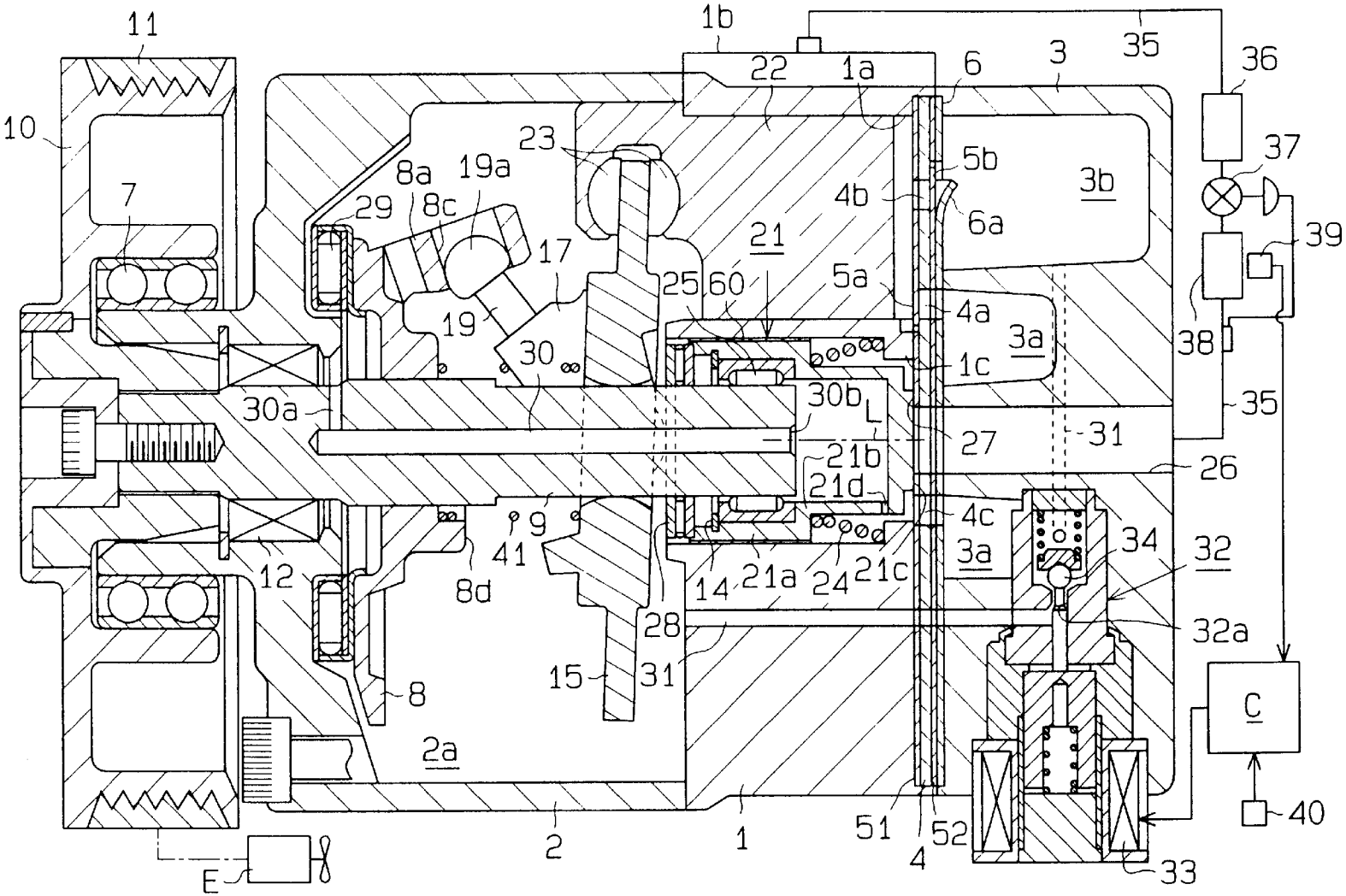
FIG. 4 is a cross-sectional view of the compressor of FIG. 1 when the shutter is located at a closed position.

As shown in FIGS. 1 and 4, a cylinder block 1 constitutes a part of the compressor housing. A front housing 2 is secured to the front end face of the cylinder block 1. A rear housing 3 is secured to the rear end face of the cylinder block 1 with a valve plate 4, a first plate 51, a second plate 52 and a third plate 6 in between. A crank chamber 2*a* is defined by the inner walls of the front housing 2 and the front end face of the cylinder block 1.

A rotary shaft 9 is rotatably supported in the front housing 2 and the cylinder block 1. The front end of the rotary shaft 9 protrudes from the crank chamber 2*a* and is secured to a pulley 10. The pulley 10 is supported by the front housing 2 with an angular bearing 7 and is directly coupled to an external drive source (a vehicle engine E in this embodiment) by a belt 11. The compressor of this embodiment is a clutchless type variable displacement compressor, which lacks a clutch between the rotary shaft 9 and the external drive source. The angular bearing 7 transfers thrust and radial loads that act on the pulley 10 to the housing 2. A lip seal 12 is located between the rotary shaft 9 and the front housing 2 for sealing the crank chamber 2*a*. The lip seal 12 prevents the gas in the crank chamber 2*a* from leaking.

Figure 2:
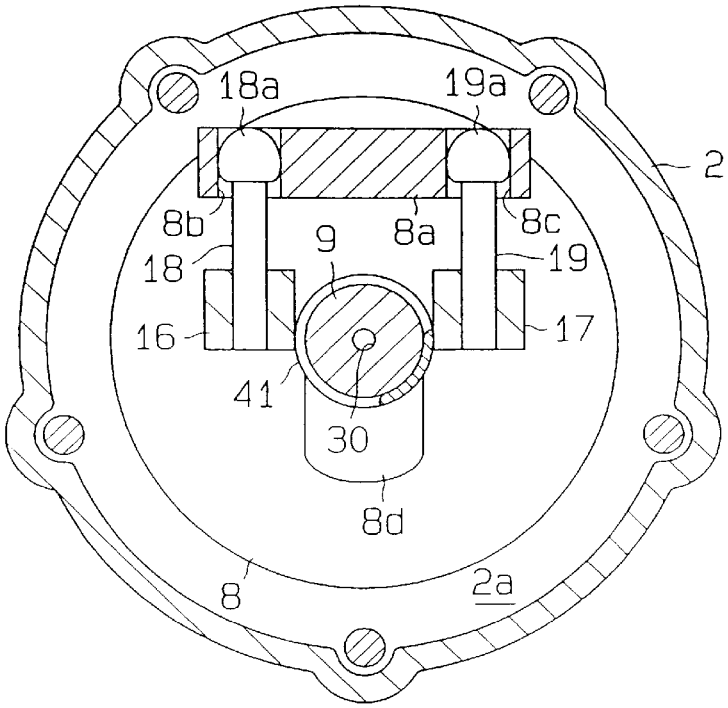
FIG. 2 is a cross-sectional view taken along line 2—2 of FIG. 1.

A rotor 8 is fixed to the rotary shaft 9 in the crank chamber 2*a*. The rotor 8 rotates integrally with the rotary shaft 9. A swash or drive plate 15 is supported by the rotary shaft 9 in the crank chamber 2*a* to be slidable along and tiltable with respect to the axis of the shaft 9. As shown in FIGS. 1 and 2, a pair of connectors 16, 17 are formed on the swash plate 15. Guide pins 18, 19 are secured to the connectors 16, 17, respectively. The guide pins 18, 19 have guide balls 18*a*, 19*a* at the distal end. The rotor 8 has a support arm 8*a* protruding toward the swash plate 15. A pair of guide holes 8*b*, 8*c* are formed in the support arm 8*a*. The guide balls 18*a*, 19*a* are slidably fitted into the corresponding guide holes 8*b*, 8*c*.

The cooperation of the arm 8*a* and the guide pins 18, 19 permits the swash plate 15 to rotate together with the rotary shaft 9. The cooperation also guides the tilting of the swash plate 15 and the movement of the swash plate 15 along the axis of the rotary shaft 9. As the swash plate 15 slides rearward toward the cylinder block 1, the inclination of the swash plate 15 decreases. The rotor 8 is provided with a projection 8*d* on its rear end face. The abutment of the swash plate 15 against the projection 8*d* prevents the inclination of the swash plate 15 beyond the predetermined maximum inclination.

A coil spring 41 is located between the rotor 8 and the swash plate 15. The spring 41 urges the swash plate 15 rearward, or in a direction decreasing the inclination of the swash plate 15.

A shutter chamber 13 having an elongated, cylindrically shaped inner peripheral wall 1*d* and a rear end wall 1*c*, is defined at the center portion of the cylinder block 1 extending along the axis L of the rotary shaft 9. A hollow cylindrical shutter member 21 having a closed end 21*c* is accommodated in the shutter chamber 13. The shutter 21 slides along the axis L of the rotary shaft 9. The shutter 21 has a large diameter portion 21*a* and a small diameter portion 21*b*. The diameter of the large diameter portion 21*a* is substantially equal to the diameter of the shutter chamber 13 so that the large diameter portion 21*a* is slidably supported by the inner peripheral wall 1*d* of the shutter chamber 13. A coating layer 60 is applied on the large diameter portion 21*a*. The coating layer 60 reduces the sliding resistance between the shutter 21 and the inner peripheral wall 1*d* of the shutter chamber 13 and is formed with, for example, polytetrafluoroethylene (PTFE).

A coil spring 24 is located between a step 21*e*, which is defined by the large diameter portion 21*a* and the small diameter portion 21*b*, and the rear end wall 1*c* of the shutter chamber 13. The coil spring 24 urges the shutter 21 toward the swash plate 15. In other words, the spring 24 urges the shutter 21 away from the first plate 51.

The spring 24 is formed by helically winding a steel wire about a conical member. The spring 24 therefore has a tapered, or conical shape. The diameter d of the steel wire is smaller than the difference between the radius $R_L$ of the large diameter portion 21*a* and the radius $R_S$ of the small diameter portion 21*b*.

Figure 1A:
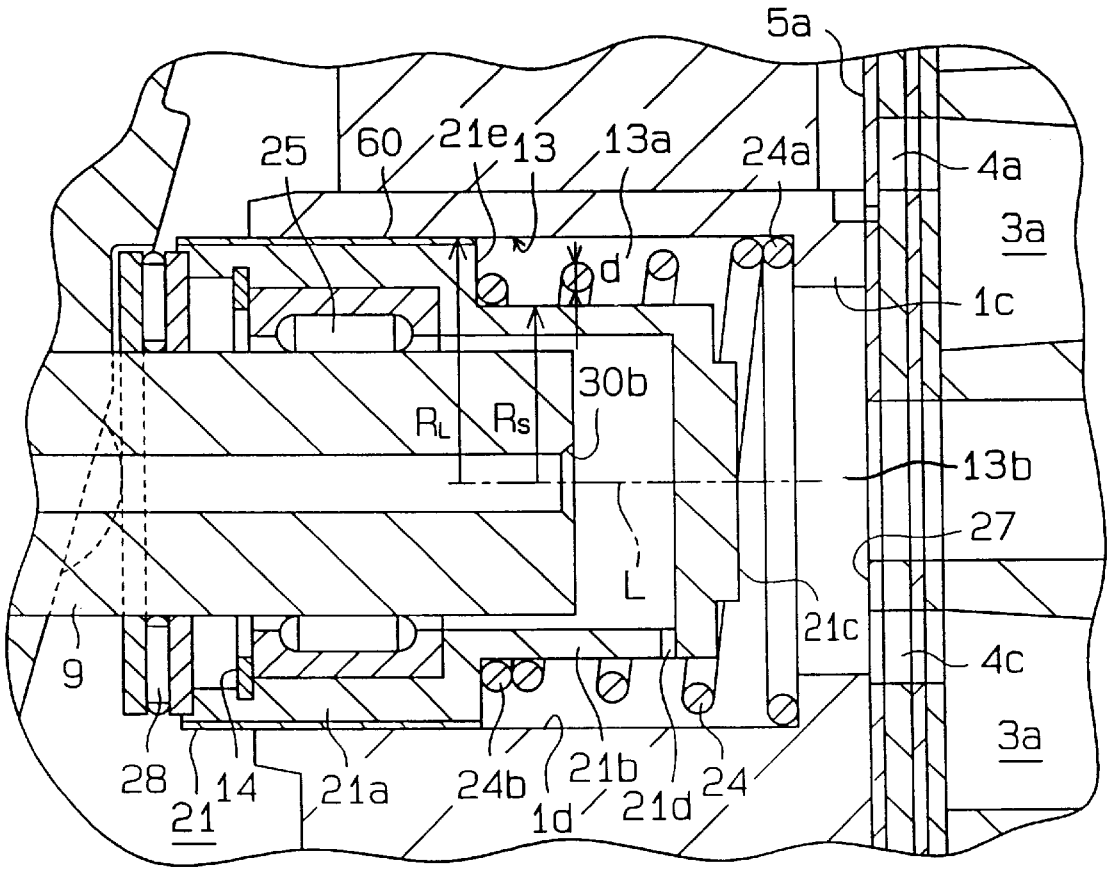
FIG. 1A is an enlarged partial cross-sectional view illustrating a shutter portion of FIG. 1.

As shown in FIGS. 1, 1A and 4, the tapered spring 24 has a large diameter end 24*a* and a small diameter end 24*b*. The spring 24 extends in a space 13*a* defined between the small diameter portion 21*b* of the shutter 21 and the inner peripheral wall 1*d* of the shutter chamber 13. The larger diameter end 24*a* of the spring 24 is engaged with the rear end wall 1*c* of the shutter chamber 13. The smaller diameter end 24*b* engages the step 21*e* defined by the large diameter portion 21*a* and the small diameter portion 21*b* of the shutter member 21. The inner diameter of the smaller diameter end 24*b* of spring 24 is substantially equal to the diameter of the small diameter portion 21*b* of the shutter 21 such that the small diameter end 24*b* fits around the smaller diameter portion 21*b* of the shutter 21. The outer diameter of the larger diameter end 24*a* of the spring 24 is substantially equal to the diameter of the shutter chamber inner peripheral wall 1*d* such that the large diameter end 24*a* engages the inner peripheral wall 1*d* of the shutter chamber 13 as well as the shutter chamber end wall 1*d*. This construction allows the spring 24 to be securely supported in the shutter chamber 13.

The rear end of the rotary shaft 9 extends into the shutter 21. A radial bearing 25 is fixed to the inner wall of the large diameter portion 21*a* by a snap ring 14. The rear end of the rotary shaft 9 is supported within by the inner peripheral wall 1*d* of the shutter chamber 13 by the radial bearing 25 and the large diameter portion 21*a* of the shutter 21 extending in between. The radial bearing 25 slides axially with the shutter 21 on the rotary shaft 9.

Figure 3:
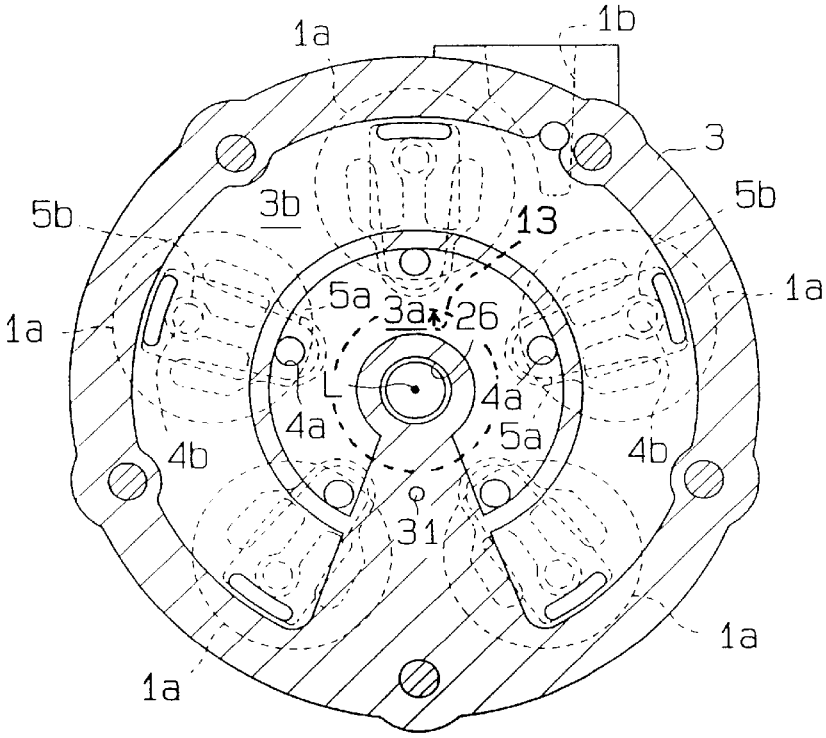
FIG. 3 is a cross-sectional view taken along line 3—3 of FIG. 1.

A suction passage 26 is defined at the center portion of the rear housing 3 and the plates 4, 51, 52, 6 to extend along the axis L of the rotary shaft 9. As shown in FIG. 3, the passage 26 has a circular cross section and the axis of the passage 26 is aligned with the axis L of the rotary shaft 9. The inner end of the passage 26 is communicated with the shutter chamber 13 through the opening 13*b* provided on the rear end wall 1*d*. A positioning surface 27 is formed on the first plate 51 about the inner opening of the suction passage 26. The rear end 21*c* of the shutter 21 functions as a shutting surface, which abuts against the positioning surface 27. Abutment of the shutter rear end 21*c* against the positioning surface 27 prevents the shutter 21 from further moving rearward away from the rotor 8. The abutment also disconnects the suction passage 26 from the shutter chamber 13.

A thrust bearing 28 is supported on the rotary shaft 9 and is located between the swash plate 15 and the shutter 21. The thrust bearing 28 slides along the axis L of the rotary shaft 9 and prevents the rotation of the swash plate 15 from being transmitted to the shutter 21. If the shutter 21 is rotated, the rotation will increase the load torque of the compressor. The load torque will be especially great when the shutting surface at the shutter rear end 21*c* is contacting the positioning surface 27. The thrust bearing 28 prevents such an increase in the load torque of the compressor.

The swash plate 15 moves rearward as its inclination decreases. As it moves rearward, the swash plate 15 pushes the shutter 21 rearward through the thrust bearing 28. Accordingly, the shutter 21 moves toward the positioning surface 27 against the force of the coil spring 24. As shown in FIG. 4, when the swash plate 15 reaches the minimum inclination, the shutting surface at the rear end 21*c* of the shutter 21 abuts against the positioning surface 27. In this state, the shutter 21 is located at the closed position for disconnecting the shutter chamber 13 from the suction passage 26.

A plurality of cylinder bores 1*a* (only one is shown in FIG. 1) extend through the cylinder block 1. A single-headed piston 22 is accommodated in each cylinder bore 1*a*. A pair of shoes 23 are fitted between each piston 22 and the swash plate 15. Rotation of the rotary shaft 9 is converted to linear reciprocation of each piston 22 in the associated cylinder bore la through the swash plate 15 and the shoes 23.

As shown in FIGS. 1 and 3, a substantially circular suction chamber 3*a* is defined in the center portion of the rear housing 3. A substantially circular discharge chamber 3*b* is defined about the suction chamber 3*a* in the rear housing 3. Suction ports 4*a* and discharge ports 4*b* are formed in the valve plate 4. Each suction port 4*a* and each discharge port 4*b* correspond to one of the cylinder bores 1*a*. Suction valve flaps 5*a* are formed on the first plate 51. Each suction valve flap 5*a* corresponds to one of the suction ports 4*a*. Discharge valve flaps 5*b* are formed on the second plate 52. Each discharge valve flap 5*b* corresponds to one of the discharge ports 4*b*.

As each piston 22 moves from the top dead center to the bottom dead center in the associated cylinder bore 1*a*, refrigerant gas in the suction chamber 3*a* is drawn into each cylinder bore 1*a* through the associated suction port 4*a* while causing the associated suction valve flap 5*a* to flex to an open position. As each piston 22 moves from the bottom dead center to the top dead center in the associated cylinder bore 1*a*, refrigerant gas is compressed in the cylinder bore 1*a* and discharged to the discharge chamber 3*b* through the associated discharge port 4*b* while causing the associated discharge valve flap 5*b* to flex to an open position. Retainers 6*a* are formed on the third plate 6. The opening amount of each discharge valve flap 5*b* is defined by contact between the valve flap 5*b* and the associated retainer 6*a*.

A thrust bearing 29 is located between the front housing 2 and the rotor 8. The thrust bearing 29 carries the reactive force of gas compression acting on the rotor 8 through the pistons 2 and the swash plate 15.

The suction chamber 3*a* is communicated with the shutter chamber 13 by a communication passage or hole 4*c*. Abutment of the shutting surface at the rear end 21*c* of the shutter 21 against the positioning surface 27 disconnects the hole 4*c* from the suction passage 26.

An axial passage 30 is defined at the center portion of the rotary shaft 9. The axial passage 30 has an inlet 30*a*, which opens to the crank chamber 2*a* in the vicinity of the lip seal 12, and an outlet 30*b* that opens in the interior of the shutter 21. A pressure release hole 21*d* is formed in the peripheral wall near the rear end of the small diameter portion 21*b* of the shutter 21. The hole 21*d* communicates the interior of the shutter 21 with the shutter chamber 13.

A pressure supply passage 31 is defined in the rear housing 3 and the cylinder block 1 for communicating the discharge chamber 3*b* with the crank chamber 2*a*. An electromagnetic valve 32 is accommodated in the rear housing 3 in the supply passage 31. The valve 32 includes a valve body 34 that faces a valve hole 32*a* and a solenoid 33 for actuating the valve body 34. When excited, the solenoid 33 causes the valve body 34 to close the valve hole 32*a*. When de-excited, the solenoid 33 causes the valve body 34 to open the valve hole 32*a*. In this manner, the electromagnetic valve 32 selectively opens and closes the supply passage 31, which extends between the discharge chamber 3*b* and the crank chamber 2*a*.

An outlet port 1*b* is formed in the cylinder block 1 and is communicated with the discharge chamber 3*b*. The outlet port 1*b* is connected to the suction passage 36 by an external refrigerant circuit 35. The refrigerant circuit 35 includes a condenser 36, an expansion valve 37 and an evaporator 38. The expansion valve 37 controls the flow rate of refrigerant in accordance with the temperature of refrigerant gas at the outlet of the evaporator 38. A temperature sensor 39 is located in the vicinity of the evaporator 38. The temperature sensor 39 detects the temperature of the evaporator 38 and issues signals relating to the detected temperature to a control computer C. The computer C selectively excites and de-excites the solenoid 33 based on the temperature detected by the temperature sensor 39.

An air conditioner starting switch 40 is connected to the computer C. If the switch 40 is turned on and the temperature detected by the sensor 39 is lower than a predetermined temperature, the computer C de-excites the solenoid 33. The computer C also de-excites the solenoid 33 when the switch 40 is turned off.

FIG. 1 illustrates the compressor in which the solenoid 33 is excited. In this state, the valve body 34 closes the valve hole 32*a* (the supply passage 31). This stops the supply of the highly pressurized refrigerant gas in the discharge chamber 3*b* to the crank chamber 2*a*. On the other hand, refrigerant gas in the crank chamber 2*a* flows into the suction chamber 3*a* via the axial passage 30 and the pressure release hole 21*d*. Accordingly, the pressure in the crank chamber 2*a* approaches the low pressure (suction pressure) in the suction chamber 3*a*. Therefore, the difference between the pressure in the crank chamber 2*a* and the pressure in the cylinder bores 1*a* becomes smaller. The inclination of the swash plate 23 thus becomes maximum and the compressor operates at the maximum displacement. Refrigerant gas in the crank chamber 2*a* is drawn into the axial passage 30 through the inlet 30*a* near the lip seal 12. Therefore, misted lubricant in the refrigerant gas lubricates between the lip seal 12 and the rotary shaft 9 and improves the sealing between the seal 12 and the shaft 9.

When the compressor is operating with a small cooling load and the inclination of the swash plate 15 is maximum, the temperature of the evaporator 38 drops to a frost forming temperature. When the temperature of the evaporator 38 detected by the sensor 39 is lower than a predetermined temperature, the computer C de-excites the solenoid 33. When de-excited, the solenoid 33 opens the supply passage 31 thereby connecting the discharge chamber 3*b* with the crank chamber 2*a*. Accordingly, highly pressurized gas in the discharge chamber 3*b* is supplied to the crank chamber 2*a* by the supply passage 31, and the pressure in the crank chamber 2*a* is increased. The pressure increase in the crank chamber 2*a* minimizes the inclination of the swash plate 15 as shown in FIG. 4. The compressor thus operates at the minimum displacement.

The computer C also de-excites the solenoid 33 when the switch 40 is turned off. The inclination of the swash plate 15 is minimized accordingly.

The swash plate 15 moves rearward as its inclination decreases. As it moves rearward, the swash plate 15 pushes the shutter 21 toward the positioning surface 27 while contracting, or compressing, the spring 24. As shown in FIG. 4, when the shutting surface at the rear end 21*c* of the shutter 21 abuts against the positioning surface 27, the swash plate 15 reaches the minimum inclination. In this state, the shutter 21 is located at the closed position for disconnecting the suction passage 26 from the suction chamber 3*a*. Refrigerant gas is therefore not drawn into the suction chamber 3*a* from the external refrigerant circuit 35. This stops the circulation of refrigerant gas between the circuit 35 and the compressor.

The minimum inclination of the swash plate 15 is slightly more than zero degrees. Zero degrees refers to the angle of the swash plate's inclination when it is perpendicular to the axis L of the rotary shaft 9. Therefore, even if the inclination of the swash plate 15 is minimum, refrigerant gas in the cylinder bores 1*a* is discharged to the discharge chamber 3*b* and the compressor operates at the minimum displacement. The refrigerant gas discharged to the discharge chamber 3*b* from the cylinder bores 1*a* is then drawn into the crank chamber 2*a* through the supply passage 31. The refrigerant gas in the crank chamber 2*a* is drawn back into the cylinder bores la through the axial passage 30, the pressure release hole 21*d* and the suction chamber 3*a*. That is, when the inclination of the swash plate 15 is minimum, refrigerant gas circulates within the compressor traveling through the discharge chamber 3*b*, the supply passage 31, the crank chamber 2*a*, the axial passage 30, the pressure release hole 21*d*, the suction chamber 3*a* and the cylinder bores 1*a*. This circulation of refrigerant gas allows the lubricant oil contained in the gas to lubricate the moving parts of the compressor.

When the inclination of the swash plate 15 is minimum as shown in FIG. 4, an increase in the cooling load increases the temperature of the evaporator 38. If the temperature of the evaporator 38 detected by the sensor 39 exceeds the predetermined temperature, the computer C excites the solenoid 33. When excited, the solenoid 33 closes the supply passage 31. This gradually decreases the pressure in the crank chamber 2*a* thereby gradually increasing the inclination of the swash plate 15.

As the swash plate's inclination increases, the force of the spring 24 gradually pushes the shutter 21 away from the positioning surface 27. This gradually increases the size of the passage between the suction passage 26 and the suction chamber 3*a* thereby gradually increasing the amount of refrigerant gas flow from the suction passage 26 into the suction chamber 3*a*. Therefore, the amount of refrigerant gas drawn into the cylinder bores 1*a* from the suction chamber 3*a* gradually increases. This gradually increases the displacement of the compressor. Thus, the discharge pressure of the compressor gradually increases, and the torque needed for operating the compressor also gradually increases accordingly. In this manner, the load torque of the compressor does not change dramatically in a short time. The shock that accompanies load torque fluctuations is therefore lessened.

The above described embodiment has the following advantages.

The spring 24 located in the shutter chamber 13 is a coil spring having a substantially conical shape; more specifically, the shape of a conical section. Therefore, when the spring 24 is expanded or contracted by movement of the shutter 21, the spring 24 does not slide against the inner peripheral wall 1*d* of the shutter chamber 13 or the small diameter portion 21*b* of the shutter 21. Thus, the spring 24 neither increases sliding resistance nor wears the inner wall peripheral wall 1*d* of the shutter chamber 13. The shutter 21 therefore moves smoothly in the shutter chamber 13. This results in an accurate control of the compressor's displacement.

The inner peripheral wall 1*d* of the shutter chamber 13 is not scratched by the spring 24 and remains smooth. Therefore, the coating layer 60 on the shutter 21 is not damaged or removed by contact with the damaged inner peripheral wall 1*d* of the shutter chamber 13. As a result, the life of the shutter 21 is increased and the durability of the compressor is improved.

If the engine E is stopped, the compressor is also stopped. Accordingly, the electromagnetic valve 32 is de-excited. The inclination of the swash plate 15 thus becomes minimum. If the nonoperational state of the compressor continues, the pressures in the chambers of the compressor become equalized but the swash plate 15 is kept at the minimum inclination by the force of spring 41. Therefore, when the engine E is started again, the compressor starts operating with the swash plate 15 at the minimum inclination. This requires only minimum torque. The shock caused by starting the compressor is thus reduced.

Tilting motion of the swash plate 15 moves the shutter 21 between the closed position, where the shutter 21 stops flow of gas from the external refrigerant circuit 35 into the suction chamber 3*a*, and the open position, where the shutter 21 permits the gas flow. Such operation of the shutter 21 reduces the load torque fluctuation of the compressor when the inclination of the swash plate 15 changes from the maximum inclination to the minimum inclination or from the minimum inclination to the maximum inclination. When the cooling load changes rapidly, the supply passage 31 is frequently opened and closed in accordance with excitement and de-excitement of the electromagnetic valve 32. However, since the shutter 21 effectively suppresses the load torque fluctuations, the switching of the valve 32 produces little shock.

It should be apparent to those skilled in the art that the present invention may be embodied in many other specific forms without departing from the spirit or scope of the invention. Particularly, it should be understood that the invention may be embodied in the following forms.

Figure 5:
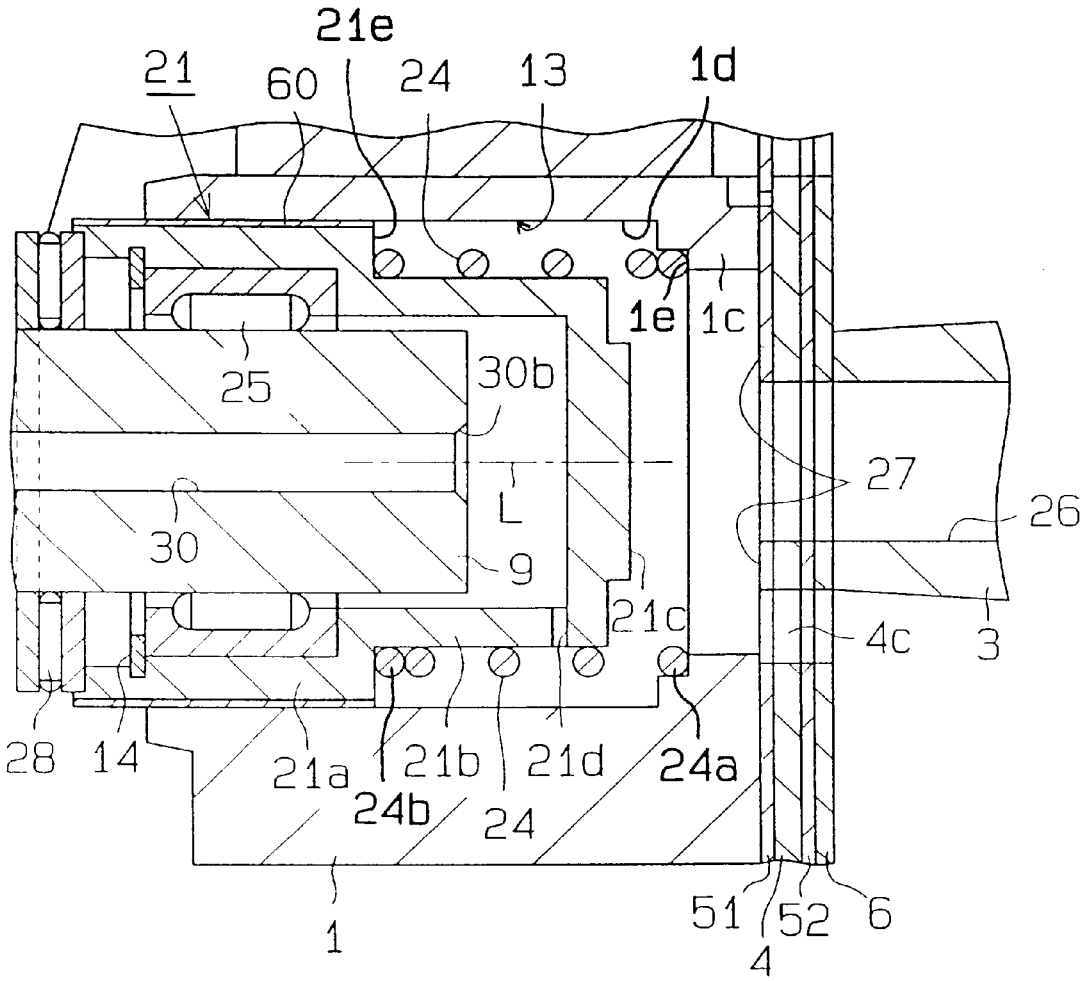
FIG. 5 is an enlarged partial cross-sectional view illustrating a compressor according to a second embodiment of the present invention when the shutter is located at an open position.

The spring 24 may have shapes other than the illustrated conical or tapered shape. For example, the spring 24 may have a cylindrical shape as shown in FIG. 5. In this case, the outer diameter of the spring 24 must be smaller than the diameter of the inner peripheral wall 1*d* of the shutter chamber 13. Also, the shutter chamber rear end wall 1*c* is provided with a step 1*e*, which is engaged with one end 24*a* of the spring 24. The step 1*e* must be defined in an area that is radially displaced from the inner peripheral wall 1*d* of the shutter chamber 13 toward the axis L so that the diameter of the step 1*e* is smaller than the diameter of the inner peripheral wall 1*d* of the shutter chamber 13, which is elongated towards the rear end wall 1*c* and is uniformly cylindrical. This construction prevents the spring 24 from sliding against the inner peripheral wall 1*d* of the shutter chamber 13. The embodiment of FIG. 5 thus has substantially the same advantages as the embodiment of FIGS. 1–4.

In the embodiment of FIGS. 1–4, the coating layer 60 is applied on the large diameter portion 21*a* of the shutter 21. However, the coating layer 60 may also be applied on the inner peripheral wall 1*d* of the shutter chamber 13.

The orientation of the spring 24 may be opposite to that illustrated. Specifically, the smaller diameter end 24*b* of the spring 24 may be engaged with the rear end wall 1*c* of the shutter chamber 13 and the larger diameter end 24*a* may be engaged with the step 21*e*, which is defined by the large diameter portion 21*a* and the small diameter portion 21*b* of the shutter 21.

Therefore, the present examples and embodiments are to be considered as illustrative and not restrictive and the invention is not to be limited to the details given herein, but may be modified within the scope and equivalence of the appended claims.

What is claimed is:

1. A compressor including a housing having a cylinder bore and a crank chamber, a drive plate located in the crank chamber and mounted on a rotary shaft, and a piston operably coupled to the drive plate and located in the cylinder bore, wherein the drive plate converts rotation of the rotary shaft to reciprocating movement of the piston, wherein the piston compresses gas supplied to the cylinder bore from an external circuit by way of a suction chamber and discharges the compressed gas from the cylinder bore to the external circuit by way of a discharge chamber, wherein the drive plate is tiltable with respect to the rotary shaft responsive to a difference between the pressure in the crank chamber and the pressure in the cylinder bore, the piston having a stroke based on the inclination of the drive plate to control the displacement of the compressor, the compressor further comprising:

a shutter chamber defined in the housing and having an elongated, cylindrically shaped inner peripheral wall and a rear end wall at one end of the inner peripheral wall, the rear end wall being provided with an opening to communicate the external circuit with the suction chamber through the shutter chamber;

a shutter member slidably accommodated in the shutter chamber, wherein the shutter member is reciprocally movable between a first position and a second position in response to the tilting motion of the drive plate, wherein the shutter member has a large diameter portion supported by the inner peripheral wall of the shutter chamber and a small diameter portion extending from the large diameter portion and radially spaced away from the inner peripheral wall of the shutter chamber, the small diameter portion having a rear end which opens said opening in the rear end wall of the shutter chamber to provide flow communication between the external circuit and the suction chamber when the shutter member is in the first position and closes the opening to disconnect the external circuit from the suction chamber when the shutter member is in the second position, and wherein the shutter member has a step defined by the conjunction between said large and small diameter portions, the step facing toward but spaced away from the rear end wall of the shutter chamber when the shutter member is in its said first and second positions; and a coil spring located in the shutter chamber to bias the shutter member in a direction toward the first position and away from the second position, wherein the coil spring has a longitudinal axis, a first end in engagement with the step of the shutter member and a second end in engagement with the rear end wall of the shutter chamber, the first end of the coil spring having an inner diameter substantially equal to the diameter of the small diameter portion of the shutter member, and wherein the coil spring is spaced radially away from the inner peripheral wall of the shutter chamber along substantially all of the spring's axial length to prevent the coil spring from sliding against the inner peripheral wall of the shutter chamber while the coil spring is being expanded or compressed during the movement of the shutter member alternately between its said first and second positions.

2. The compressor according to claim 1, wherein the coil spring is a conically shaped coil spring between its first and second ends.

3. The compressor according to claim 1, wherein the coil spring is cylindrically shaped and has an outer diameter at each of its said first and second ends and along its length that is smaller than the diameter of the shutter chamber inner peripheral wall.

4. The compressor according to claim 1, wherein the coil spring is formed by helically winding a wire, wherein the large diameter portion has a diameter substantially corresponding to the diameter of the shutter chamber inner peripheral wall.

5. The compressor according to claim 4, wherein the coil spring is located in a space within said shutter chamber defined between the small diameter portion and the inner peripheral wall of the shutter chamber, and wherein the wire that forms the coil spring has a diameter smaller than the difference between the radius of the large diameter portion and the radius of the small diameter portion of the shutter member.

6. The compressor according to claim 5, wherein the rear end wall of the shutter chamber has a step comprising a circumferentially recessed portion of the shutter chamber rear end wall facing toward the shutter member step, the second end of the coil spring engaging said step of the shutter chamber rear end wall.

7. The compressor according to claim 1, wherein the diameter of the coil spring increases from that at the location where its said first end engages the step of the shutter member to that at the location where its said second end engages the rear end wall of the shutter chamber.

8. The compressor according to claim 6, wherein the coil spring has a uniform diameter, and wherein the outer diameter of the coil spring along its length is smaller than the diameter of the inner peripheral wall of the shutter chamber.

9. The compressor according to claim 1 further comprising:

a passage communicating the shutter chamber with the suction chamber;

a suction passage defined in the housing to connect the external circuit with the shutter chamber, wherein gas is supplied to the suction chamber from the external circuit through the suction passage and the shutter chamber; and a positioning surface of the housing located substantially within said opening of the shutter chamber rear end wall and facing the shutter member to be abutted by the shutter member when the shutter member moves to close the rear end wall opening to disconnect the suction passage from the shutter chamber.

10. A compressor including a housing having a cylinder bore and a crank chamber, a drive plate located in the crank chamber and mounted on a rotary shaft, and a piston operably coupled to the drive plate and located in the cylinder bore, wherein the drive plate converts rotation of the rotary shaft to reciprocating movement of the piston, wherein the piston compresses gas supplied to the cylinder bore from an external circuit by way of a suction chamber and discharges the compressed gas from the cylinder bore to the external circuit by way of a discharge chamber, wherein the drive plate is tiltable with respect to the rotary shaft responsive to a difference between the pressure in the crank chamber and the pressure in the cylinder bore, the piston having a stroke based on the inclination of the drive plate to control the displacement of the compressor, the compressor further comprising:

a shutter chamber defined in the housing and having an elongated inner peripheral wall and a rear end wall at one end of the inner peripheral wall, the rear end wall being provided with an opening to communicate the external circuit with the suction chamber through the shutter chamber;

a shutter member slidably accommodated in the shutter chamber, the shutter member being movable along the axis of the rotary shaft between a first position and a second position in response to the tilting motion of the drive plate, wherein the shutter member opens the opening of the rear end wall of the shutter chamber to provide flow communication between the external circuit and the suction chamber when in the first position and closes the opening to disconnect the external circuit from the suction chamber when in the second position;

said shutter member having a large diameter portion and a small diameter portion defining therebetween a step on the shutter member facing said rear end wall of the shutter chamber, wherein the large diameter portion has a diameter substantially corresponding to the diameter of the inner peripheral wall of the shutter chamber, and a tapered coil spring located in the shutter chamber and mounted on said small diameter portion of the shutter member to bias the shutter member in a direction toward its said first position and away from its said second position, the coil spring having a first end and a second end opposite to the first end, the first end engaging the step of the shutter member and the second end engaging the rear end wall of the shutter chamber, wherein the diameter of the coil spring tapers between its first end and its second end and is out of contact with said inner peripheral wall of the shutter chamber along the length of the coil spring when the coil spring is being expanded and compressed during the movement of the shutter member alternately between its said first and second positions.

11. The compressor according to claim 10, wherein the coil spring is formed by helically winding a wire, wherein a diameter of the coil spring wire is smaller than the difference between the radius of the large diameter portion and the radius of the small diameter portion of the shutter member.

12. The compressor according to claim 11 further comprising:

a passage communicating the shutter chamber with the suction chamber;

a suction passage defined in the housing to connect the external circuit with the shutter chamber, wherein gas is supplied to the suction chamber from the external circuit through the suction passage and the shutter chamber; and a positioning surface of the housing located within said opening of the shutter chamber rear end wall and facing the shutter member to be abutted by the shutter member when the shutter member moves to close the rear end wall opening of the shutter chamber.

13. The compressor according to claim 12, wherein the diameter of the coil spring increases uniformly from the first end to the second end of the coil spring.

* * * * *

UNITED STATES PATENT AND TRADEMARK OFFICE

CERTIFICATE OF CORRECTION

PATENT NO. : 6,126,406
DATED : October 3, 2000
INVENTOR(S) : Kawaguchi et al.

It is certified that error appears in the above-identified patent and that said Letters Patent is hereby corrected as shown below:

Title page,
Item [56] References Cited, please change, "19612395A1" to -- 19612385A1 --;

Column 3,
Line 54, please change, "chamber 13 having" to -- chamber 13, having --;

Column 4,
Line 41, please change, "supported within by the" to -- supported within the --;
Line 52, please change "rear end wall 1d" to -- rear end wall 1c -- and Column 8,
Lines 2-3, please change, " the inner wall peripheral wall 1*d*" to -- the inner peripheral wall 1*d* --.

Signed and Sealed this

Second Day of April, 2002

*Attest:*

*Attesting Officer*

JAMES E. ROGAN
*Director of the United States Patent and Trademark Office*